US005499557A

United States Patent [19]

Fry

[11] Patent Number: 5,499,557

[45] Date of Patent: Mar. 19, 1996

[54] DRAIN PLUG REMOVING DEVICE

[76] Inventor: James K. Fry, 1661 NW. 107 Ave., Plantation, Fla. 33322

[21] Appl. No.: 183,837

[22] Filed: Jan. 21, 1994

[51] Int. Cl.[6] ..... B25B 17/00; B25B 13/52

[52] U.S. Cl. ..... 81/57.29; 81/125; 81/DIG. 1; 81/64

[58] Field of Search ..... 81/57.29, 57.13, 81/57.42, 125, 64, 3.43, DIG. 1, 436

[56] References Cited

U.S. PATENT DOCUMENTS

| | | | |
|---|---|---|---|
| 1,728,619 | 9/1929 | Lambert | 81/DIG. 1 |
| 1,739,182 | 12/1929 | Schlote | 81/DIG. 1 |
| 2,507,167 | 5/1950 | Lemmerman | 81/436 |
| 2,906,153 | 9/1959 | Erb | 81/57.29 |
| 3,972,252 | 8/1976 | Hunter | 81/57.29 |
| 5,199,331 | 4/1993 | Tsukamoto | 81/125 |

FOREIGN PATENT DOCUMENTS

| | | | |
|---|---|---|---|
| 2848608 | 5/1980 | Germany | 81/57.29 |

*Primary Examiner*—Bruce M. Kisliuk
*Assistant Examiner*—Joni B. Danganan
*Attorney, Agent, or Firm*—Malloy & Malloy

[57] ABSTRACT

A drain plug removing device including a removable socket located at the head of the device, which socket is adapted to securedly engage and hold the head of a threaded drain plug. The socket is fixedly coupled to the upper external member of a retaining socket holder, the lower section of which is disposed within a cavity of the device head in fixed engagement with a crown gear adapted for rotation within the cavity. A pinion gear is movably coupled within the head cavity to the crown gear. A tubular housing having a chamber in communication with the head cavity is fixedly connected to the device head. A drive shaft disposed within, and extending throughout the length of, the chamber is fixedly coupled at one of its ends to the pinion gear. At its other end, the drive shaft is fixedly coupled to a rotatable external handle positioned adjacent the end of the housing opposite the device head, whereby rotation of the handle is translated through the drive shaft and the gears to produce a simultaneous rotation of the socket holder, the socket and a drain plug engaged therein. Oil drain ports are included in the device head to allow excess oil to drain therefrom, and the invention may also include a separate portable receptacle into which the device head is placed to receive the excess oil that drains from the device head through its drain ports.

6 Claims, 1 Drawing Sheet

DRAIN PLUG REMOVING DEVICE

BACKGROUND OF THE INVENTION

1. Field of the Invention

The invention relates to the removal of threaded drain plugs and the like from containers such as automotive engine oil pans for replacement of oil or other fluids present therein, and more particularly, to a drain plug removing device which can be used without oil being spilled onto the user's hand and without the drain plug being dropped after it has been removed from the oil pan.

2. Description of the Related Art

The mechanic who performs maintenance on an automobile, truck, boat or the like is familiar with the awkwardness and messiness of removing fluid drain plugs from the vehicle's engine oil pans or sump. Generally, the removal of such a drain plug includes first loosening the plug with a wrench and then unscrewing and removing the plug by hand. When the last thread of the drain plug disengages from the oil pan, however, the oil changer must attempt to snatch the plug away from the on-rushing stream of often hot oil, while trying not to drop the plug into the used oil receptacle. More often than not, hot and dirty oil spills onto the oil changer's hand, potentially resulting in burns and many times causing the oil changer to drop the plug into the used oil receptacle, thus requiring him to grope in the dirty oil to retrieve the plug.

There are numerous oil change and drain plug devices proposed in the related art, including expired U.S. Pat. No. 1,668,245 to McGowan disclosing a rotating crankcase drain funnel having a drain hose and a socket for removing the drain plug.

Expired U.S. Pat. No. 1,686,749 to Higgins et al. discloses an oil catch basin with a geared drain plug-removing wrench mounted thereon.

Expired U.S. Pat. No. 3,967,697 to Guenther discloses a crankcase oil drainage and collection device that requires a special drain plug having a passageway therein such that on partial removal of the plug, oil can drain from the crankcase into a funnel that directs the oil into an oil container.

U.S. Pat. No. 4,230,002 to Skidmore discloses a device for removing a plug and draining oil from a vehicle oil pan including a socket for removing the drain plug, a funnel for catching draining oil and an oil drain hose.

None of the above-described devices have enjoyed any significant degree of commercial success, primarily because of the time and expense in making use of them. All of these devices have drawbacks, some requiring alteration of the plug to be removed, others requiring hand holding of a funnel while draining the oil.

U.S. Pat. No. 4,145,939 to Garrison discloses a drain plug holder having a socket attached to a short manually rotatable spindle with a chain connected thereto. The socket includes a magnet for holding a drain plug, and the chain can be secured at one end thereof to the bottom of the car. A drain plug is removed by rotating the spindle, and if the plug drops, it may be held by the magnet. However, the location of the spindle does not ensure that hot oil will not gush onto the user's fingers, and if the plug drops with sufficient momentum, the magnetic attraction can break and allow the plug to fall into the used oil receptacle. In addition, the momentum of the falling drain plug and consequent oscillation of the chain may cause oil coating the end of the plug to splatter outside of the used oil receptacle.

U.S. Pat. No. 4,794,827 to Poling discloses a drain plug removing device having a rotatable socket with winglets, for engaging and selectively holding a head of a drain plug. One end of a flexible line is connected to the rotatable socket, and similar to the Garrison device, the other end of the line is secured to a support to prevent the socket and drain plug from falling further than the length of the line, if dropped, and to support the line and the socket holding the drain plug. This device also suffers the disadvantage created by the momentum of the falling drain plug and consequent oscillation of the line, namely, the resultant outward splattering of oil coating the end of the drain plug.

U.S. Pat. No. 4,862,776 to Poling discloses a drain plug removing device having a clip for rotatably engaging and selectively holding a head of a threaded drain plug. The device includes a selectively bendable, flexible shaft attached to the clip at one end thereof, the shaft being formed of a reboundable coil spring extending away from the clip. The shaft has a handle at another end thereof opposite the clip such that rotation of the handle applies rotational force to the shaft which in turn applies rotational force to the clip, causing rotation of the clip and the drain plug held therein. This device suffers from a drawback created by the rapid unbending of the flexed shaft upon removal of the drain plug, which unflexing movement can cause oil coating the end of the drain plug to splatter outwardly.

U.S. Pat. No. 5,199,331 to Tsukamoto discloses a drain plug remover including a drain plug holding socket, a shield member and a handle. The shield member extends outwardly from the base of the socket to initially catch and subsequently deflect the flow of dirty oil away from the hand of the user. Extending from the shield member opposite the socket is a handle which the user rotates to unscrew the plug. A disadvantage of this device, however, is that the user is required to remain in close proximity to the engine oil pan, so that the user without a vehicle lift who has to crawl underneath a jacked-up vehicle to unscrew the drain plug must remain laying on his back in a cramped, uncomfortable position directly underneath the oil pan while rotating the handle of this device.

There remains a need in the art for a simple, portable, lightweight, easy-to-clean drain plug removing device which allows the user to remove a drain plug from an engine oil pan without undue discomfort, while avoiding the spillage of oil onto the user's fingers, the dropping of the plug into the used oil receptacle, and the splattering of oil outside of the used oil receptacle. The device of the present invention is adapted to meet these needs.

SUMMARY OF THE INVENTION

It is an object of the present invention to provide a simple, portable, lightweight device that can be used to remove an oil drain plug from a engine oil pan while avoiding spilling oil onto the user's hands or splattering oil coating the end of drain plug outside of the used oil receptacle.

Another object of the present invention is to provide an easy-to-use, portable device that will hold an oil drain plug after it has been removed from an engine oil pan, thereby enabling the user to avoid dropping the drain plug into the used oil receptacle.

A further object of the present invention is to provide a portable, hand-holdable device that can be easily drained of excess oil that has spilled onto it after the drain plug has been removed from the engine oil pan.

In accordance with one aspect of the present invention, there is provided a drain plug removing device which includes a removable drain plug retaining socket located at the head of the device, which device head is fixedly coupled to a tubular housing. A cavity in the device head is in internal communication with a chamber in the housing. The retaining socket is made of a resilient material and is formed having an open end which is slightly smaller than the drain plug head and includes longitudinal slits in its side wall, such that when the retaining socket is pressed upon a drain plug head, the socket expands to securably engage and hold the drain plug head. A magnet located within the socket provides an additional means of holding the drain plug in place in the socket. The retaining socket is fixedly connected to the upper external member of a retaining socket holder, the lower section of which is disposed within the head cavity. The base of the lower internal section of the retaining socket holder is fixedly mounted upon a crown gear that is rotatably disposed within the head cavity. The crown gear movably engages a pinion gear also located in the head cavity. A drive shaft is disposed within, and extends throughout the length of, the housing chamber from a first end that is fixedly coupled to the pinion gear to a second end that is coterminous with the end of the housing opposite the device head. A rotatable external handle is positioned adjacent such opposite end of the housing in fixed engagement with the drive shaft, whereby rotation of the handle applies rotational force to both the drive shaft and pinion gear, the rotation of which in turn applies rotational force to the crown gear, thereby producing a simultaneous rotation of the retaining socket holder, retaining socket, and a drain plug held therein. Oil drain ports are included in the device head to allow the drainage of excess oil therefrom, and the invention may also include a separate portable receptacle into which the device head is placed to receive the excess oil that drains through the device's drain ports.

BRIEF DESCRIPTION OF THE DRAWINGS

The invention will be better understood after reading the following detailed description of the presently preferred embodiment thereof with reference to the appended drawings in which.

DETAILED DESCRIPTION OF THE PREFERRED EMBODIMENT

Figure 1:
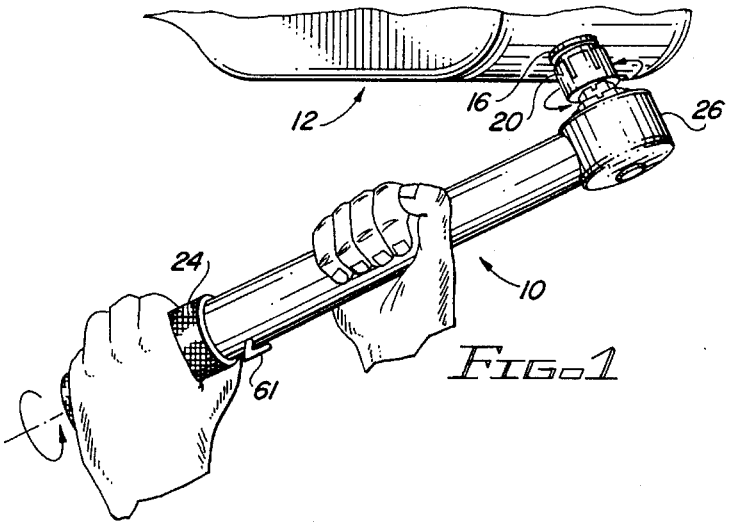
FIG. 1 illustrates a preferred embodiment of the drain plug removing device in use.

Referring to the drawings, there is shown in FIG. 1 a preferred embodiment of the drain plug removing device 10 in use. Vehicles having an engine oil pan 12 commonly have formed therein a drain hole from which a threaded drain plug 16 may be removed to permit the changing of its engine oil. In using the device 10, the drain plug 16 initially is loosened by a conventional wrench. After loosening, the device 10 is attached by means of a retaining socket 20 to the head of the drain plug 16 and is rotated at its handle 24 so as to unscrew the drain plug 16 from the oil pan 12. It is to be understood that since various sizes of drain plug 16 are utilized in different vehicles, the present invention may be provided with a plurality of sockets 20 shaped to accommodate a variety of drain plug sizes and shapes. As the user unscrews the last thread of the drain plug 16 and removes it from the oil pan 12, engine oil escapes from the oil pan 12 and begins to flow onto the device head 26. The drain plug 16 is held by the device 10, so that upon the completion of oil drainage, the device 10 may be used to reinsert and rescrew the drain plug 16 into the drain hole by rotation of the handle 24.

Figure 2:
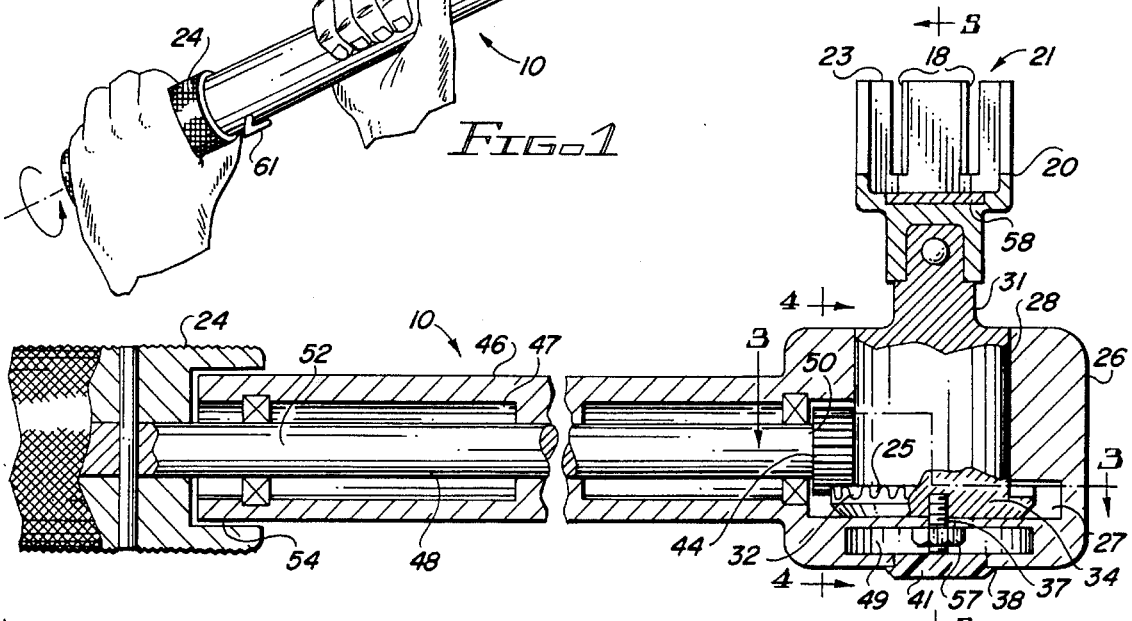
FIG. 2 illustrates a cross-sectional view of the device of FIG. 1, with the retaining socket and retaining socket holder in place.

FIGS. 2–5 illustrate a preferred embodiment of the drain plug removing device 10. The device 10 includes a removable retaining socket 20 which is formed to securely engage the head of the drain plug. Secured engagement is desired so that the drain plug 16 may be both removed and replaced without having to physically handle the drain plug 16 itself; the drain plug 16 being securely held in the socket 20 until it is reinserted back into the drain hole of the oil pan 12. Preferably, the socket 20 is formed of a hard, durable, resilient material such as plastic, wherein its open end 21 is formed to be slightly smaller than the head of the drain plug. Longitudinal slits 18 are formed in the side wall 23 of the socket 20 at its open end 21 so as to permit slight resilient expansion when pressed upon the head of the drain plug 16. The socket 20 thus expands in use to securely grasp the drain plug 16. As seen in FIG. 2, a permanent magnet 58 is located within the socket 20 adjacent the position of the head of the drain plug 16 as an additional means of holding the drain plug 16 in place in the socket 20.

Figure 5:
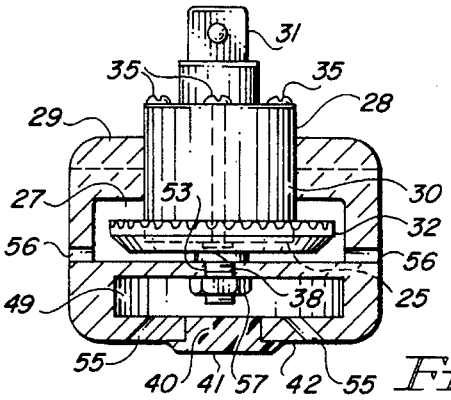
FIG. 5 also illustrates a partial sectional view from the front of the device, cut along lines 5—5 shown in FIG. 2.

The retaining socket 20 is connected to a retaining socket holder 28 that has a lower section 30 located in a first cavity 27 formed within the head 26 of the device 10. The socket holder 28 has an upper external member 31 which is formed to securedly receive the retaining socket 20. The lower section 30 and upper external member 31 of the socket holder 28 are preferably integrally formed with each other. The socket holder 28 has four threaded bores extending longitudinally therethrough. As shown in FIG. 5, a cover 29 having an aperture dimensioned to receive the socket holder 28 and allow it to rotate freely therein is securedly positioned on the device head 26.

Figure 3:
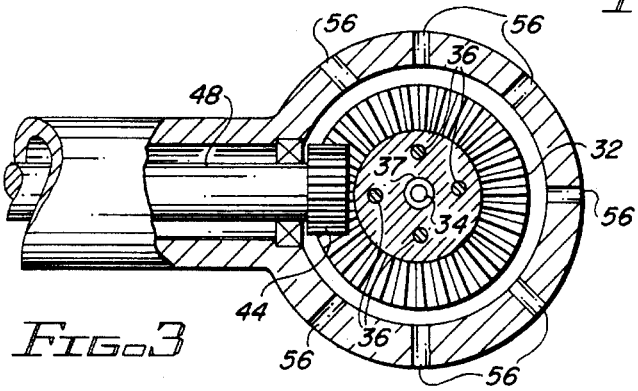
FIG. 3 illustrates a sectional view from the top of the device, cut along lines 3—3 shown in FIG. 2.

As seen in FIG. 2, the socket holder base 25 is positioned on a rotatable crown gear 32 disposed within the first cavity 27. As shown in FIG. 3, the crown gear 32 has four threaded recesses 36, which are in corresponding alignment with the four threaded bores of the socket holder 28. Each of the four threaded recesses 36 and its corresponding bore is dimensioned to receive a threaded bolt screw 35 so that the socket holder 28 is fixedly secured to the crown gear 32. The crown gear 32 also has a centrally located opening 34 in which a fastener 37 is fixedly disposed.

The device head 26 has a second cavity 49 that is disposed below and separate from the first cavity 27. As seen in FIG. 5, the first cavity 27 communicates with the second cavity 49 by means of a cylindrical channel 53 that is in alignment with the crown gear opening 34. The bottom 42 of the device head 26 has a centrally located opening 40 that is in alignment with the channel 53 and crown gear opening 34. A pin 38 having a head 57 with a diameter larger than that of the channel 53 and a distal end is disposed within the channel 53, the distal end of the pin being rotatably positioned within and held by the fastener 37, so that the crown gear 32 and fastener 37 are able to rotate together freely within the device head 26 around the pin 38. A cap 41 is fixedly disposed within the central opening 40 at the device head bottom 42. A pinion gear 44 (FIG. 3) is also disposed in the first cavity 27 in movable engagement with the crown gear 32.

Figure 4:
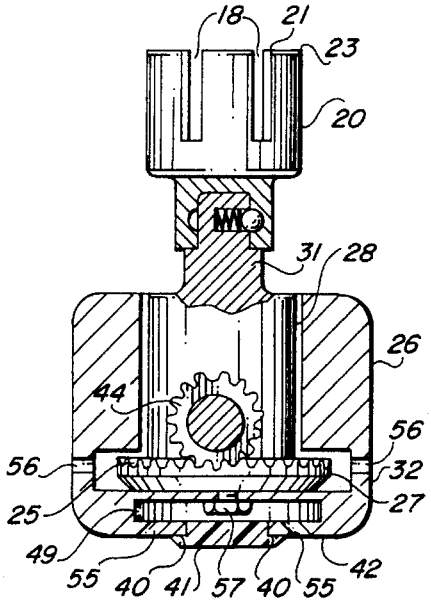
FIG. 4 illustrates a partial, cross-sectional view of the device cut along lines 4—4 shown in FIG. 2.

As shown in FIG. 2, extending from the device head 26 and fixedly connected thereto is a tubular housing 46 having a cylindrical chamber 47 in communication with the first cavity 27. A drive shaft 48 is disposed within the housing chamber 47 and extends therethrough from a first end 50 of the shaft 48 which is fixedly coupled to the pinion gear 44, to a second end 52 of the shaft 48 which is fixedly secured to a rotatable handle 24. The handle 24 is positioned adjacent the end 54 of the housing 46 opposite the device head 26. A removable bearing may be included within the chamber 47 in contact with the pinion gear 44 at the first end 50 of the shaft 48. Another removable bearing may be included between the handle 24 and the housing end 54. The device head 26 includes a plurality of evenly spaced side drain ports 56 that extend from the first cavity 27 to the external surface on the side of the device head 26. In addition, as seen in FIGS. 4 and 5, there are bottom drain ports 55 in the device head 26 that extend from the second cavity 49 to the external surface of the device head bottom 42.

In the use of this invention, as illustrated in FIG. 1, the user first loosens the drain plug 16 with a wrench. After loosening, the user presses the retaining socket 20, which has previously been connected by the user to the retaining socket holder 28 of the device 10, over the head of the drain plug 16 until the socket 20 securely grasps the drain plug 16. When the socket 20 is seated so as to securely grasp the drain plug 16, the magnet 58 magnetically engages the drain plug head. The user then rotates the handle 24 of the device 10 in the appropriate direction to unscrew the drain plug 16, causing the drive shaft 48 and the pinion gear 44 to rotate in the same direction as the handle 24, i.e., clockwise or counterclockwise, as the case may be. The rotation of the pinion gear 44 causes the crown gear 32 with which it is movably engaged to also rotate in the same direction as the handle 24. The rotation of the crown gear 32 causes the retaining socket holder 28 fixedly mounted upon it, the retaining socket 20 coupled to the socket holder 28, and the drain plug 16 securedly engaged with the socket 20 to rotate together, thereby causing the drain plug 16 to become unscrewed from the oil pan 12. The user continues to rotate the handle 24 until the drain plug 16 is completely unscrewed from the oil pan 12 and can be removed therefrom.

After the drain plug 16 is removed from the oil pan 12, the device head 26 can be placed in a receptacle which receives excess oil that drains from the head 26 through the drain ports 55 and 56. Alternatively, can be equipped with an attachment means, such as a hook 61, for hanging the device from a wall or other suitable support structure to allow the excess oil to drain through the drain ports 55 and 56 from the head of the device. The drain plug 16 is held by the retaining socket 20, so that upon completion of oil pan drainage, the device 10 can be used to reinsert and rescrew the drain plug 16 into the drain hole by rotation of the handle 24 in the appropriate direction. After the drain plug 16 has been completely rescrewed into the oil pan 12 but not tightened, the device 10 is removed from the drain plug 16 by the user's pulling the handle 24 in a direction opposite from the plug 16 until the retaining socket 20 and magnet 58 disengage from the drain plug head. The user may then tightly screw the drain plug 16 into the oil pan 12 with a wrench. The device head 26 again can be placed into the receptacle or hung from a wall to allow excess oil to drain from the head 26 through the drain ports 55 and 56. Once the device 10 has been sufficiently drained of oil, it can thereby be easily cleaned before being returned to the user's toolbox.

Since many modifications, variations and changes in detail can be made to the described preferred .embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A drain plug removing device comprising:

(a) a housing having a first end and a second end, said housing having a chamber extending from said first end to said second end;

(b) a head connected to said first end of said housing, said head having a cavity in communication with said chamber;

(c) a socket holder having a lower section disposed within said head cavity and a member projecting externally from said head;

(d) a socket adapted to fixedly engage said external member of said socket holder, said socket being formed to engage a drain plug head;

(e) a crown gear disposed within said head cavity, said crown gear being fixedly coupled to said lower section of said socket holder, said crown gear being adapted for rotation within said head cavity;

(f) means disposed within said device head for securely yet rotatably fixing said crown gear within said device head, with respect to which said crown gear rotates coaxially;

(g) a pinion gear disposed within said head cavity, said pinion gear being movably coupled to said crown gear;

(h) a drive shaft disposed within and extending throughout the length of said housing chamber, said drive shaft having a first end and a second end, said first end of said drive shaft being fixedly coupled to said pinion gear; a (i) a rotatable handle positioned adjacent said second end of said housing, said handle being fixedly connected to said second end of said drive shaft, whereby rotation of said handle applies rotational force to said drive shaft, causing said drive shaft and said pinion gear to rotate together and in turn to apply rotational force to said crown gear, whereby the resulting rotation of said crown gear produces a simultaneous rotation of said socket holder, said socket and a drain plug securedly engaged with said socket; and (j) said device head including at least one aperture for allowing oil to drain therefrom.

2. A drain plug removing device as recited in claim 1 wherein said lower section and said external member of said socket holder are integrally formed with each other.

3. A drain plug removing device as recited in claim 1 wherein said socket includes means for securely holding the drain plug within said socket.

4. A drain plug removing device as recited in claim 3 wherein said socket includes an open end and is formed of resilient material, wherein said means for securely holding the drain plug within said socket include having said open end formed slightly smaller than the drain plug head and having at least one longitudinal slit formed at said open end of said socket to permit resilient expansion of said socket when pressed upon the drain plug head.

5. A drain plug removing device as recited in claim 3, wherein said means for securely holding the drain plug within said socket includes a magnet.

6. A drain plug removing device as recited in claim 1 further including attachment means at a lower zone of the second end of the housing for hanging the device from a supporting structure to allow for drainage of excess oil from the device.

* * * * *